United States Patent [19]

Bell

[11] Patent Number: 5,042,635

[45] Date of Patent: Aug. 27, 1991

[54] RAPID COIN ACCEPTOR

[75] Inventor: Edward H. Bell, Chambersburg, Pa.

[73] Assignee: Jani Supplies Enterprises, Inc., Havertown, Pa.

[21] Appl. No.: 415,900

[22] Filed: Oct. 2, 1989

[51] Int. Cl.[5] ..... G07F 3/02

[52] U.S. Cl. ..... 194/346; 194/317

[58] Field of Search ..... 194/346, 317, 318, 319

[56] References Cited

U.S. PATENT DOCUMENTS

| | | | |
|---|---|---|---|
| 3,918,564 | 11/1975 | Heiman et al. | 194/318 |
| 4,105,105 | 8/1978 | Braun | 194/346 X |
| 4,267,916 | 5/1981 | Black et al. | 194/317 |
| 4,650,057 | 3/1987 | Koester | 194/346 |
| 4,901,838 | 2/1990 | Crossman | 194/346 |

FOREIGN PATENT DOCUMENTS

| | | | |
|---|---|---|---|
| 0298814 | 1/1989 | European Pat. Off. | 194/346 |
| 0326051 | 8/1989 | European Pat. Off. | 194/346 |
| 2423315 | 11/1975 | Fed. Rep. of Germany | 194/346 |
| 1168990 | 7/1985 | U.S.S.R. | 194/319 |

*Primary Examiner*—Robert J. Spar
*Assistant Examiner*—William M. Hienz
*Attorney, Agent, or Firm*—Eckert Seamans Cherin & Mellott

[57] ABSTRACT

A rapid coin acceptor is disclosed which is capable of discriminating valid coins or tokens from counterfeit coins or tokens and for accepting the valid coins or tokens as they fall by gravity through the device. The coin acceptor includes a coin introduction chute which receives coins or tokens and directs the coins by gravity feed to a coin sensing gate which is positioned in vertical registry below the bottom of the coin introduction chute. The coin sensing gate is equipped with a plurality of sensors to sense various parameters of the coin or token for authentication purposes as the coin or token drops through the coin sensing gate. The coin sensing gate is designed of height between one and one and one-half times the diameter of the coin to assure substantially instantaneous response to prevent the rapid insertion of a spurious coin from defeating the sensor control. Upon sensing and authenticating a coin within the time period of travel of the coin within the coin sensing gate, a gate operator will be activated to deflect the valid coin or token into a properly positioned coin accept channel.

18 Claims, 2 Drawing Sheets

RAPID COIN ACCEPTOR

BACKGROUND OF THE INVENTION

1. Field of the Invention

The present invention relates generally to the field of coin checkers and acceptors, and more particularly, is directed to a coin or token sensing device capable of rapid acceptance of authentic coins or tokens and rapid rejection of counterfeits.

2. Description of the Prior Art

Automatic coin operated machines and mechanisms have become increasingly popular both in the United States and in many foreign countries. Early coin operated devices such as telephones have become increasingly more sophisticated in their coin accepting mechanisms and means have been provided to receive, check, sort, escrow and even return a large number of coins of varying denomination and size. Other coin or token activated machines, such as the popular coin operated washers and dryers, have resulted in the establishment of entirely new industries as a direct result of the improved nature of the coin accepting mechanisms. Of course, since the legalization of gambling in the states of Nevada and New Jersey and in various foreign countries, coin operated gaming devices known as slot machines now produce a most significant fraction of the entire gaming industry gross revenue. Other coin operated devices that have now established an accepted place in the daily routine of everyday life include cigarette vending machines, candy vending machines, article vending machines, liquid drink dispensing machines in either bottle or open cup configuration, and the like.

Just as sure as the various types of coin operated mechanisms have become increasingly popular, unscrupulous individuals have increasingly been tempted to develop slugs and other articles especially designed to defeat the coin checking facilities incorporated within the coin accepting mechanisms. Because of this, prior workers in the art have developed many construction features for use with the coin accepting mechanisms which have been particularly designed to minimize the acceptance of bad coins and slugs and to discourage tampering.

Coin gaming devices, such as slot machines, have now been designed to accept all denominations of coins from as low as five cents to as high as one dollar or more. Most recently, very valuable tokens, for example, tokens of $500 denomination have been introduced in the casinos and have become increasingly popular. With tokens of such value, it is extremely important that the coin checking systems function with extreme accuracy and with complete reliability. Coin checking mechanisms for this high end segment of the coin industry are currently of the type described in U.S. Pat. Nos. 4,326,621, 4,354,587, 4,334,604 and 4,359,148 to Davies and the coin checking device sold by Coin Mechanisms, Inc., Elmhurst, Ill. under the designation "Coin Comparitor Model CC-40."

While the above prior art coin acceptors or rejectors have become increasingly popular, these prior art designs suffer from a common design flaw in that the distance from the area wherein the coin or token is electronically tested and the gating mechanism that is employed to deflect a valid coin or token is too great. This distance is usually in the neighborhood of between 1½ and 2 diameters of the coin or token being checked or more. This geometry determines that the coin or token being checked in the sensing area is not the same coin or token that is present within the accept or reject mechanism. The greater the distance between the coin checking and the coin gating provides an increased time gap wherein a skilled person can defeat the mechanism. With a sufficient time period within which to act, the coin checking mechanism can be defeated by quickly placing and feeding a counterfeit coin or token which is interleaved with a valid coin or token. When the time lag is of sufficient duration, there is a possibility that a skilled person can cheat the coin acceptor or rejector by feeding a spurious coin or token in rapid succession following a genuine coin. By pursuing this course, should the circuitry recognize the first coin as being genuine, the spurious coin quickly following in rapid succession may still be accepted by the machine because of the inability of the accept solenoid or other coin accept mechanism to respond quickly enough to reject the spurious coin.

SUMMARY OF THE INVENTION

The present invention relates generally to the field of coin acceptors or rejectors, and more particularly, relates to an improved apparatus for rapidly accepting only genuine coins or tokens of a particular value or denomination and to reject spurious coins or other improper tokens.

The rapid coin acceptor of the present invention comprises generally a compact coin or token checking mechanism wherein an inlet coin chute or coin slot extends exteriorly of the associated machine to a convenient location to receive therein coins or tokens of a predetermined value or denomination. The inlet chute directs the coin or token by gravity directly to a movable coin sensing gate of length sufficient to receive the coin or token therewithin.

The movable coin sensing gate is equipped with a plurality of various types of coin sensors wherein the authenticity of the coin or token, the size of the coin or token, the material content of the coin or token, the acoustic nature of the coin or token, etc. can be determined, all within the very short time period span required to allow the coin or token to drop by gravity through the movable coin sensing gate. In a preferred embodiment, the coin sensing gate is pivotal about an axis in response to the signals from the various sensors.

It is of prime importance in this invention that the coin sensing gate operator be substantially immediately responsive to the signals of the various coin sensors. The signals generated by the various sensors and the response of the gate operator must all take place within a very small segment of time, that is within the time period that it takes for the coin or token to fall by gravity through the coin sensing gate. Preferably, the height or length of the coin sensing gate should be in the size range of between one and one and one-half coin diameters.

In the event that all of the sensors indicate that the coin or token being checked is authentic, the gate operator will be immediately responsive to such signals to pivot or otherwise move the coin sensing gate before the coin or token falls through the coin sensing gate, whereby the authentic coin will be diverted into the coin accept channel for subsequent acceptance within the associated device. In the event that one or more of the sensors determines that the coin or token being checked is spurious, the gate operator will not function and the coin or token will fall by gravity directly through the coin sensing gate into a reject channel wherein the spurious coin or token may or may not be returned to the operator.

It is contemplated that one or more of the coin or token sensors will be applied directly on or about the movable coin sensing gate whereby such sensors will move when the gate itself is moved. Alternately, some or most of the sensors can be applied adjacent to the coin sensing gate in stationary locations whereby such coin sensors will not move when the gate operator is functioned. By checking the coin or token directly within the coin sensing gate and then moving the gate to accept an authentic coin before it has the time to fall through the gate, the previous rapid feeding or "stuffing" of a counterfeit coin will have no effect on the rapid coin acceptor of the present invention.

It is therefore an object of the present invention to provide an improved rapid coin acceptor of the type set forth.

It is another object of the present invention to provide a novel rapid coin acceptor that includes a movable coin sensing gate and means to discriminate between genuine coins and spurious coins during the time period that the coin remains within the movable coin sensing gate.

It is another object of the present invention to provide a novel rapid coin acceptor comprising a coin introduction chute, a coin sensing gate receiving coins by gravity from the coin introduction chute, coin sensing means associated with the coin sensing gate to check the authenticity of the coin directly within the coin sensing gate and rapid gate operation means to move the coin sensing gate in response to signals from the coin sensing means to divert authentic coins into a coin accept channel within the time span defined by the time period required for gravity fall of the coin through the coin sensing gate.

It is another object of the present invention to provide a novel rapid coin acceptor comprising a coin introduction chute, a movable coin sensing gate in vertical registry below the coin introduction chute, a plurality of coin sensors secured to the movable gate, the length of the gate being less than 1½ times the diameter of the coin being checked, a coin reject channel in vertical registry below the coin introduction chute and a coin accept channel positioned in offset relationship below the bottom of the movable coin sensing gate wherein the gate must function within the time span of the coin passing through the gate by gravity in order to divert an authentic coin into the proper coin accept channel.

It is another object of the present invention to provide a novel rapid coin acceptor that is simple in construction, extremely rapid in response and trouble-free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

DESCRIPTION OF THE PREFERRED EMBODIMENT OF THE INVENTION

Figure 5:
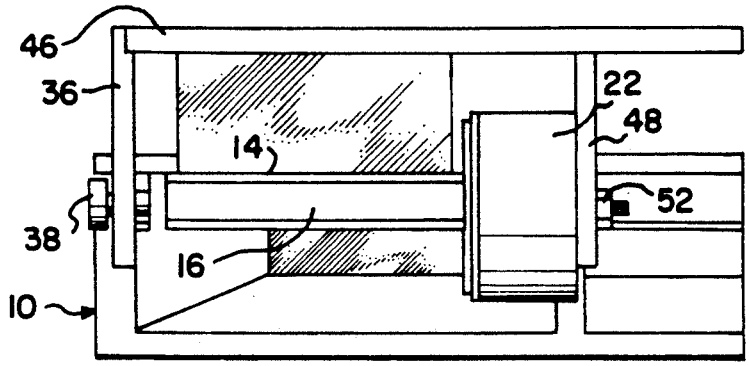
FIG. 5 is a top plan view of the rapid coin acceptor looking from line 5—5 on FIG. 2 in the direction of the arrows.

Although specific terms are used in the following description for the sake of clarity, these terms are intended to refer only to the particular structure of the invention selected for illustration in the drawings, and are not intended to define or limit the scope of the invention.

Figure 1:
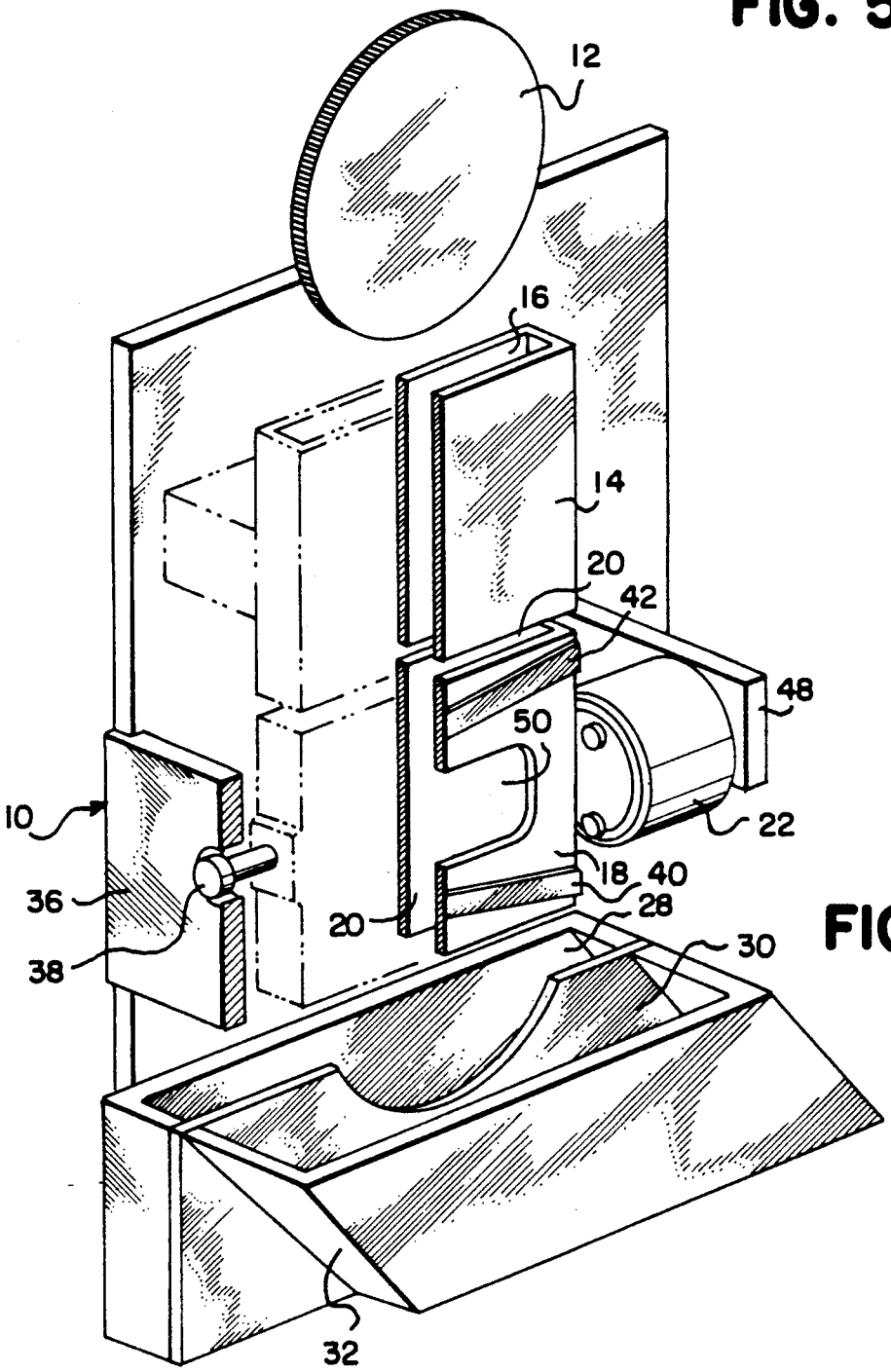
FIG. 1 is a perspective view of a rapid coin acceptor constructed in accordance with the teachings of the present invention, and partially broken away and partially in phantom to expose interior construction features.

Referring now to the drawings, there is shown in FIG. 1 a rapid coin acceptor 10 constructed in accordance with the teachings of the present invention and suitable to accept an authentic, preselected coin or token 12. The coin or token 12 can be of any predetermined denomination, size, shape, metallic composition or the like and the various sensors 40, 42 can be designed, constructed and applied in known manner to substantially instantaneous check for desired coin characteristics in a manner to very accurately and very quickly authenticate the coin or token 12.

Figure 2:
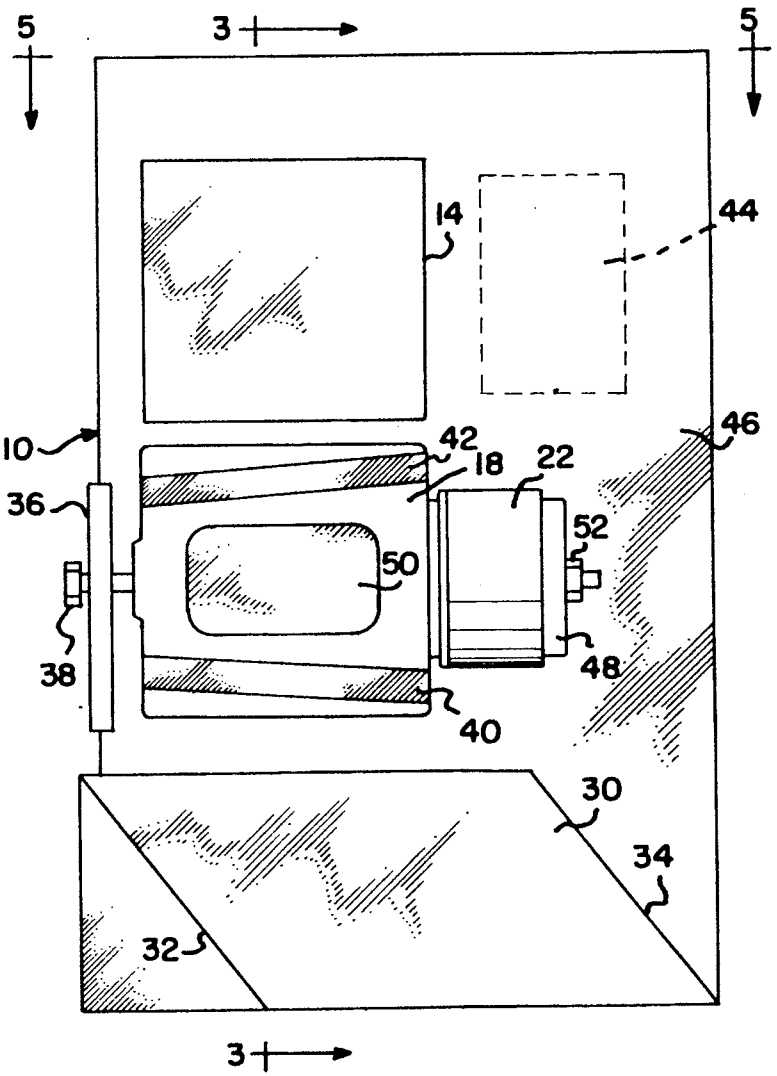
FIG. 2 is a side elevational view of the rapid coin acceptor of FIG. 1, at reduced scale.

Still referring to FIG. 1 and further considering FIGS. 2 and 5, the rapid coin acceptor 10 comprises generally a coin introduction chute 14 which may be of suitable length and configuration to extend exteriorly of the associated coin operated device (not shown) in convenient position to accept coins or tokens 12. The coin introduction chute 14 is preferably rectangular in configuration and includes sidewalls which define a generally vertically arranged coin passage 16 therewithin. The device is intended for gravity operation, and accordingly the coin passage 16 is preferably arranged as close to the vertical as conveniently possible. In the illustrated embodiment, the coin introduction chute 14 can be secured to the coin acceptor base or back plate 46 in stationary manner by employing a support block or bracket 54. The coin introduction chute 14 orients and positions the dropping coin or token 12 in suitable alignment to enter the movable coin sensing gate 18 for coin checking and authentication purposes as hereinafter more fully set forth. As illustrated, the coin sensing gate 18 is normally positioned in vertical registry directly below the bottom of the coin introduction chute 14.

Figure 4:
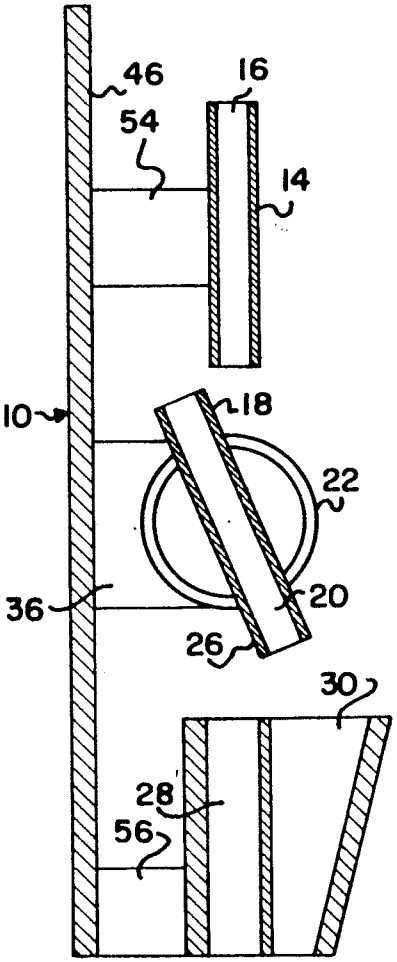
FIG. 4 is a cross sectional view similar to FIG. 3, showing the movable coin sensing gate in the coin reject position.
Figure 3:
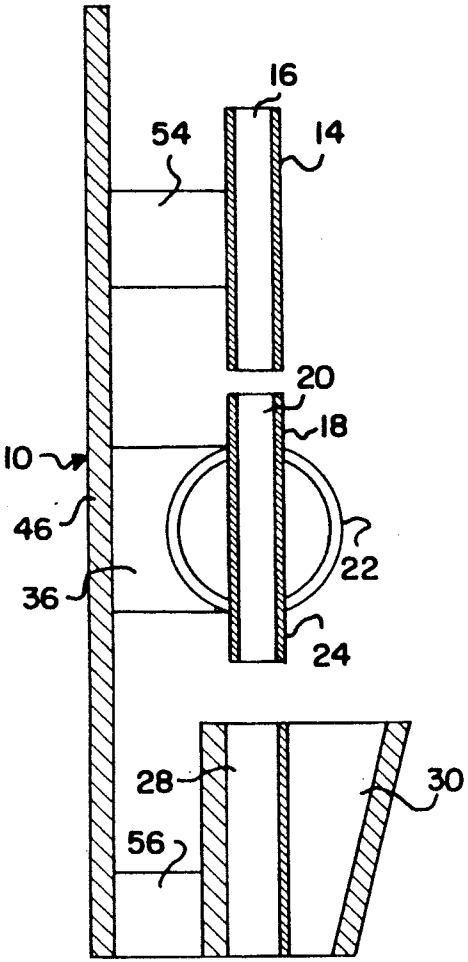
FIG. 3 is a cross sectional view taken along lines 3—3 on FIG. 2, looking the direction of the arrows, and showing the movable coin sensing gate in the coin accept position.

The movable coin sensing gate 18 is intended to be rapidly moved upon sensing the presence of an authentic coin or token 12 to divert the coin or token into the proper coin accept channel 30. In the event that the inserted coin or token 12 cannot be authenticated by the sensors 40, 42 as the coin is within the coin sensing gate 18, then the coin sensing gate 18 will not move and the spurious coin or token will fall vertically downwardly by gravity into the coin reject channel 28. While a pivotally movable coin sensing gate 18 is illustrated in the preferred embodiment, it will be appreciated that other movements and other mechanisms could be employed to cause diversion of an authentic coin in response to sensor signals and not to move when the sensors detect a spurious coin or token. Suffice it to say that whatever particularly type of gate moving mechanism is employed, it is an important feature of this invention that the coin sensing gate 18 be rapidly movable from a normal, first, vertical coin reject position 24 as illustrated in FIG. 4 to a second, coin accept position 26 as illustrated in FIG. 3, all within the time period or time span required for a coin to fall by gravity through a distance that is no greater than one and one-half times the diameter of the coin itself.

In the illustrated embodiment, the movable coin sensing gate 18 is fabricated to be generally rectangular in cross section configuration having enclosing sidewalls which define an enclosed coin passage 20 therewithin. If desired or necessary, one or more of the sidewalls comprising the coin sensing gate 18 can be provided with a suitable opening 50 to allow visual observation of the coin progress, or perhaps, to facilitate placement of some type of sensor that may require an unobstructed interface with the coin or token 12 as it passes through the coin acceptor 10. An opening 50 that may be provided must be sufficiently small so as the prevent the coin or token 12 from inadvertently escaping from the coin passage 20.

It is a design feature of this invention that all of the sensing systems will be positioned to rapidly monitor and sense various parameters of the coin or token 12 as the coin or token passes through the coin passage 20 of the coin sensing gate 18. Accordingly, the height of the coin sensing gate 18 should be at least as high as the diameter of the coin 12. Inasmuch as almost instantaneous response will be necessary to defeat rapid feeding of a spurious coin as above set forth, it is necessary that the height of the coin passage 20 be no greater than one and one-half times the diameter of the coin or token 12. Accordingly, all of the sensors 40, 42 associated with the coin sensing gate 18 must be designed for substantially instantaneous sensing and response whereby a coin or token 12 can be authenticated accurately as rapidly within the time span that the coin will require to fall by gravity through a coin passage 20 of length between one and one-half diameters of the coin itself.

Many varieties and constructions of sensors 40, 42 have been designed by prior workers in the art to monitor and check coin or token characteristics or parameters such as sensors to detect magnetic properties, sensors to discriminate between paramagnetic, diamagnetic and ferromagnetic alloys, sensors to determine the physical shape and dimensions of the coin under test, sensors to measure the inductive permeability of the coin under test, sensors to determine the number of electrons in the valence shell of the surface material of the coin under test, secondary inductive sensors to provide protection against sintered plastic or metal filled ceramic counterfeit coins, acoustic sensors to determine the density and shape of the coin under test and so forth. In other words, numerous sensors are currently available that can be employed in conjunction with the coin sensing gate 18 to determine various parameters to make sure of absolute accuracy in operation. A suitable micro computer and electronic circuit board 44 having components as necessary to control and b responsive to the sensors 40, 42 can be secured to the base 46 and can be wired to the various sensors 40, 42 in known manner for efficient operation by persons skilled in the art.

In the illustrated embodiment, a high speed rotary gate operator 22 is responsive to the sensors 40, 42 and is affixed to the movable coin sensing gate 18 in a manner to rotate the gate 18 between the normally vertical, coin reject position 24 as shown in FIG. 4 to the angularly offset or pivoted coin accept position 26 as illustrated in FIG. 3. The gate operator 22 can be secured to a base mounted support bracket 48 by employing suitable small bolts 52 or other fasteners. A pivot pin 38 is rotatable within an opposite support wall 36 and pivotally carries the side of the gate 18 remote from the gate operator 22. The gate operator 22 must be responsive to function by the sensors 40, 42 in minimal time whereby the gate 18 can be urged to the coin accept position 26 within the time period required for the coin to fall by gravity through a distance from one coin diameter to 1 ½ diameters, that is, through the height of the coin sensing gate 18. The gate operator 22 comprises a spring (not shown) which functions rapidly and precisely to normally urge the movable coin sensing gate 18 to its coin reject position 24. (See FIGS. 2 and 4). Upon receipt of coin authentication signals from the sensors 40, 42 within the given time span, the gate operator 22 functions to overcome the bias of the said spring to rapidly pivot or otherwise move the coin sensing gate 18 to the said coin accept position 26 as illustrated in FIG. 3.

In the illustrated embodiment, the coin sensors 40, 42 are shown in direct association with the coin sensing gate 18 and accordingly, the sensors 40, 42 will move when the gate 18 itself is moved. Alternatively, it is contemplated that one or more of the sensors 40, 42 could be positioned in stationary relationship to the coin sensing gate 18 wherein they could perform their coin authentication functions without cooperative movement with the gate 18. In either type of construction, it is an important feature of this invention that the coin or token 12 be checked and authenticated directly within the gate and not before reaching the gate.

After the coin or token 12 passes through the coin sensing gate 18 and is properly authenticated or rejected in response to function of the sensors 40, 42, rejected coins will fall by gravity through the lower positioned coin reject channel 28, which channel is in vertical registry below the coin introduction chute 14 and the coin passage 20 within the coin sensing gate 18 when the coin sensing gate is spring biased to its normal, first coin reject position 24. The rejected coin or token 12 will fall by gravity through the coin reject channel 28 and from there, the rejected coin may be returned to the user or may be locked and impounded to prevent further attempts to employ a spurious coin, according to the design of the coin acceptor 10.

Upon authentication of the coin or token 12 by the sensors 40, 42, the gate operator 22 will substantially instantaneously be activated to pivot the movable coin sensing gate 18 to the said coin accept position 26 as shown in FIG. 3. It will be noted that the coin or token 12 resides within the coin passage 20 of the coin sensing gate 18 during the entire coin checking and gating process. The coin that is checked must be the same coin that moves with the gate to drop into the coin accept channel 30. Upon proper authentication, the bottom of the coin passage 20 will then be diverted laterally of the coin reject channel 28 and will vertically align over the top of the coin accept channel 30, whereby the properly authenticated coin will be directed through the coin accept channel 30 to the machine coin box (not shown)

or perhaps to some type of coin actuated operator (not shown), if such a device is to be employed. The coin accept channel 30 is defined by forwardly inclined sidewalls 32, 34 to lead and direct the authenticated coin or token 12 to the predetermined receptor (not shown) that is provided for properly authenticated coins in well known manner.

Although the invention has been described with a certain degree of particularity, it is understood that the present disclosure has been made only by way of example and that numerous changes in the details of construction and the combination and arrangement of parts may be resorted to without departing from the spirit and scope of the invention. Thus, the scope of the invention should not be limited by the foregoing specification, but rather, only by the scope of the claims appended hereto.

What is claimed is:

1. A coin acceptor for distinguishing and sorting authentic coins from unauthentic coins, the authentic coins having attributes distinct from the unauthentic coins including at least two of predetermined diameter, denomination, size and composition, the coin acceptor comprising:

a coin introduction chute to guide the coin along a coin introduction path;

a movable coin sensing gate in registry below the coin introduction chute, the coin sensing gate being provided with a coin passage positioned to receive coins from the coin introduction chute, the coin sensing gate being movable between a first, coin reject position and a second, coin accept position;

a plurality of sensors directed to the coin passage at the coin sensing gate, the sensors including means operable for checking the authenticity of the coin as the coin resides within the coin passage at the coin sensing gate by sensing at least size and composition, the sensors generating signals in response to the passage of an authentic coin; and, a gate operator connected to the coin sensing gate and being responsive to signals from the plurality of coin sensors, the gate operator being operable to move the coin sensing gate from the first, coin reject position to the second, coin accept position when the plurality of sensors properly authenticate the coin and while the coin is still within the coin passage of the coin sensing gate.

2. The coin acceptor of claim 1, wherein the coin passage in the coin sensing gate is at least equal in length to the diameter of the coin.

3. The coin acceptor of claim 1, wherein said coin passage in the coin sensing gate has a length of between approximately one coin diameter and one and one-half coin diameters.

4. The coin acceptor of claim 1, wherein the coin introduction chute positions the coin introduction path in generally vertical alignment and wherein the coin falls by gravity along the coin introduction path to the coin sensing gate.

5. The coin acceptor of claim 1, wherein the movable coin sensing gate is positioned in generally vertical alignment and in registry below the coin introduction chute when the coin is first inserted into the coin introduction chute.

6. The coin acceptor of claim 1, wherein the gate operator rapidly moves the coin sensing gate from the coin reject position to the coin accept position prior to the coin exiting the coin passage of the coin sensing gate, and wherein the gate operator is operable to return to the coin reject position prior to sensing of a next successive coin at the coin sensing gate.

7. The coin acceptor of claim 1, wherein at least one of the sensors is supported directly upon the coin sensing gate.

8. The coin acceptor of claim 7, wherein said at least one of the sensors moves with the coin sensing gate when the coin sensing gate is moved from the first position to the second position.

9. The coin acceptor of claim 1, wherein the gate operator comprises means biasing the coin sensing gate toward the first position, said means biasing the coin sensing gate rapidly returning the coin sensing gate from the second position to the first position after the plurality of sensors function to move the coin sensing gate.

10. The coin acceptor of claim 1, wherein the coin sensing gate is pivotally movable between the said first and second positions.

11. A rapid coin acceptor for accepting authentic coins of known diameter and composition, comprising:

a coin introduction chute;

a movable coin sensing gate in vertical registry below the coin introduction chute, the coin sensing gate and the coin introduction chute defining a coin passage;

a plurality of coin sensing means directed at the coins within the movable gate, the coin sensing means including sufficient sensors at the movable gate to distinguish authentic coins by diameter and composition while the coin is within the movable gate, the length of the movable gate and an operative sensing length of the sensors being less than one and one-half times the diameter of the coin being checked;

a coin reject channel invertical registry below the coin introduction chute, and a coin accept channel positioned in offset relationship below a bottom of the movable coin sensing gate;

a gate operator means responsive to the coin sensing means to move the coin sensing gate from a first, coin reject position to a second, coin accept position; and, wherein the sensors and the gate function to identify an authentic coin and to position the coin sensing gate to one of the first and second positions within a time span of the coin passing through the gate by gravity.

12. The coin acceptor of claim 11, wherein the coin sensing gate is positioned in vertical alignment when in the said first, coin reject position such that failure of the sensors to signal an authentic coin within said time span allows the coin to fall into the coin reject channel.

13. The coin acceptor of claim 11, wherein the coin sensing gate is movably pivotable on a pivotal axis and wherein the gate operator means pivots the coin sensing gate about the pivotal axis when moving the gate from the first position to the second position.

14. The coin acceptor of claim 13, wherein the gate operator means comprises means, continuously biasing the coin sensing gate from said second position toward said first position.

15. A method of accepting authentic coins having preselected attributes, the authentic coins having a known diameter and composition, the method comprising the steps of:

introducing the coin into a coin introduction chute and allowing the coin to fall by gravity in the coin introduction chute, along a coin path;

receiving the falling coin within a coin passage along the coin path, in a movable coin sensing gate normally directed along a coin reject path, and allowing the coin to fall by gravity through the coin passage in the movable coin sensing gate, toward the coin reject path;

sensing the attributes of the coin while within the coin passage with sensors sufficient to distinguish coins for authenticity;

moving the coin sensing gate to direct the movable coin sensing gate toward a coin accept path prior to the coin exiting the coin passage, upon sensing an authentic coin;

accepting the authentic coin from the moved coin sensing gate; and, rejecting coins not sensed to be authentic while within the movable coin sensing gate.

16. The method of claim 15, wherein the sensing comprises sensing said attributes within a time period required for the coin to fall by gravity through a distance equal to between one and one and one-half times the diameter of the coin.

17. The method of claim 16, wherein the moving comprises pivotally moving the coin sensing gate from the coin reject path to the coin accept path, and returning the coin sensing gate to the coin reject path, for each authentic coin passing the coin sensing gate.

18. The method of claim 17, wherein the sensing comprises moving the sensors in unison with the movement of the coin sensing gate.

* * * * *